United States Patent [19]

Yum

[11] Patent Number: 5,056,507

[45] Date of Patent: Oct. 15, 1991

[54] COMBINATION FOOT SUPPORT AND FOOT MASSAGING DEVICE

[76] Inventor: Steve Yum, 8107 Overlake Ct., Fairfax Station, Va. 22039

[21] Appl. No.: 538,533

[22] Filed: Jun. 15, 1990

[51] Int. Cl.[5] ..... A61H 7/00

[52] U.S. Cl. ..... 128/62 R; 128/44; 128/60; 128/61

[58] Field of Search ..... 128/24.2, 25 B, 32, 128/34, 35, 36, 44, 48, 49, 60, 61, 62 R

[56] References Cited

U.S. PATENT DOCUMENTS 2,534,412 12/1950 Burnett et al. ..... 128/49
4,429,687 2/1984 Friedson et al. ..... 128/24.2

FOREIGN PATENT DOCUMENTS 3416641 11/1985 Fed. Rep. of Germany ..... 128/32

*Primary Examiner*—Mickey Yu
*Assistant Examiner*—Brian E. Hanlon
*Attorney, Agent, or Firm*—Burns, Doane, Swecker & Mathis

[57] ABSTRACT

A foot massaging device for supporting and massaging both feet of a person simultaneously while the person is comfortably seated with the person's legs extending vertically and the person's feet angled downwardly such that point pressure from the device is applied to soles of the feet. The device includes a support having a lower surface adapted to rest on a floor and protrusions on an upper surface of the support. The protrusions include a first group having upper surfaces thereof arranged so as to support the sole of each foot such that the heel of the foot is vertically above the toes of the foot. The protrusions also include a second group having upper surfaces thereof arranged so as to support the toes of the foot such that they are bent upwardly at an angle to the sole of the foot. A third group of protrusions can be provided for supporting the ball of the foot and additional groups of protrusions can be provided for massaging a foot which is not supported on the first and second groups of protrusions. The support includes a cut-out for receiving a leg of a chair so that the device can be positioned directly beneath a person sitting in the chair.

20 Claims, 1 Drawing Sheet

COMBINATION FOOT SUPPORT AND FOOT MASSAGING DEVICE

FIELD OF THE INVENTION

The invention relates to a device for supporting one or both feet of a person and provides a massaging effect thereto.

BACKGROUND OF THE INVENTION

Footstools for supporting one or both feet of a person are well known in the art as shown by U.S. Pat. No. 740,071 ("Allen"). Other types of support for the feet include a cushion as disclosed in U.S. Pat. No. 2,748,838 ("Scholl") and U.S. Pat. No. 4,076,876 ("Bowles"). U.S. Pat. No. 4,539,977 ("Schneider") discloses a therapeutic support for supporting one or both feet of a seated individual to provide therapeutic relief to the individual's lower back.

It is also known in the art to provide devices which provide a massaging effect to the feet. For instance, U.S. Pat. No. 4,852,553 ("Voykin") discloses stimulators having protrusions, knobs, or ridges for stimulating reflex zones of the foot. In U.S. Pat. No. 3,757,774 ("Hatuno") discloses a massage sandal having projections of various heights for purposes of stimulating the soles of the feet and facilitating the circulation system of the blood within the soles of the feet. U.S. Pat. No. 3,744,483 ("Picolin") discloses a mat having projections for stimulating the muscles of the feet and legs. U.S. Pat. No. 4,329,981 ("Dungl") discloses a foot massage mat having hill-like raised portions or protuberances and the protuberances can be sized and spaced such that one protuberance fits into the free space formed below the foot arch to support the arch while the toes bear upon a neighboring protuberance.

The foregoing U.S. Patents do not include automated mechanisms for massaging the feet. A foot treatment apparatus which includes a mechanical vibrator assembly and means for providing heat to the feet is disclosed in U.S. Pat. No. 4,446,855 ("Friedson"). U.S. Pat. No. 4,807,602 ("Scarborough") discloses a foot massager which sprays water upwardly on the soles of a user's feet and includes a reciprocating support plate for providing a massaging action to the soles of a user's feet.

SUMMARY OF THE INVENTION

An object of the invention is to provide a foot massaging device which can support and massage both feet of a person simultaneously while the person is comfortably seated with the person's legs extending vertically and the person's feet angled downwardly such that the point pressure from the device is applied to soles of the feet. The device includes a support having a lower surface adapted to rest on a floor and protrusions on an upper surface of the support. The protrusions include a first group having upper surfaces thereof arranged so as to support the sole of each foot such that the heel of the foot is vertically above the toes of the foot. The protrusions also include a second group having upper surfaces thereof arranged so as to support the toes of the foot such that they are bent upwardly at an angle to the sole of the foot.

The device can also include a third group of protrusions having upper surfaces thereof vertically below the upper surfaces of the second group and arranged so as to support the ball of the foot. The device can also include a fourth group of protrusions having upper surfaces thereof arranged to be out of contact with the foot when the foot is supported on the first and second groups of protrusions, the fourth group of protrusions being usable to massage a foot which is not supported on the first and second groups of protrusions. The first group of protrusions can be supported on a first surface of the support and the second group of protrusions can be supported on a second surface of the support, the first and second surfaces being inclined such that they are closer together at a lower end thereof than at an upper end thereof. The third group of protrusions can have upper surfaces thereof arranged so as to support the ball of the foot and the third group of protrusions can be supported on a third surface extending between the first and second surfaces. The second surface can form an angle with the third surface which is about equal to an angle formed between the first and third surfaces. The first group of protrusions can include long protrusions and short protrusions, the long protrusions being arranged to support the plantar arch of each foot and the short protrusions being arranged to support the remainder of the soles of each foot. The third group of protrusions can comprise at least one row of protrusions extending in a direction parallel to adjoining edges of the first and third support surfaces. Likewise, the fourth group of protrusions can comprise at least one row of hemispherical protrusions extending in a direction parallel to adjoining edges of the fourth and second surfaces. For instance, the fourth group can comprise two parallel rows of protrusions. Also, the fifth group of protrusions can comprise at least one row of hemispherical protrusions extending in a direction parallel to adjoining edges of the fifth and first surfaces. For instance, the fifth group can comprise two parallel rows of protrusions.

According to a preferred embodiment of the invention, a fourth group of protrusions and a fifth group of protrusions are provided. The third group of protrusions are located between the first and second groups of protrusions and the second group of protrusions are located between the fourth and third groups of protrusions, and the first group of protrusions are located between the fifth and third groups of protrusions. The fourth group of protrusions have upper surfaces which are spaced further from the lower support surface than the upper surfaces of the third group of protrusions. The fifth group of protrusions have upper surfaces which are spaced further from the lower support surface than the upper surfaces of the fourth group of protrusions. In accordance with the invention, the protrusions can include sidewalls depending from the upper surfaces thereof with the sidewalls being parallel to each other. The upper surfaces of the protrusions can be rounded.

According to the invention, the support can include a cut-out means extending through a central part of one side thereof for receiving a horizontally extending leg of a swivel chair to facilitate placement of the support directly under the chair. The cut-out can extend through a side of the support such that it passes through the fifth surface and part of the first surface.

BRIEF DESCRIPTION OF THE DRAWINGS

The invention is described with reference to the attached drawings, in which.

DETAILED DESCRIPTION OF THE PREFERRED EMBODIMENTS

Figure 1:
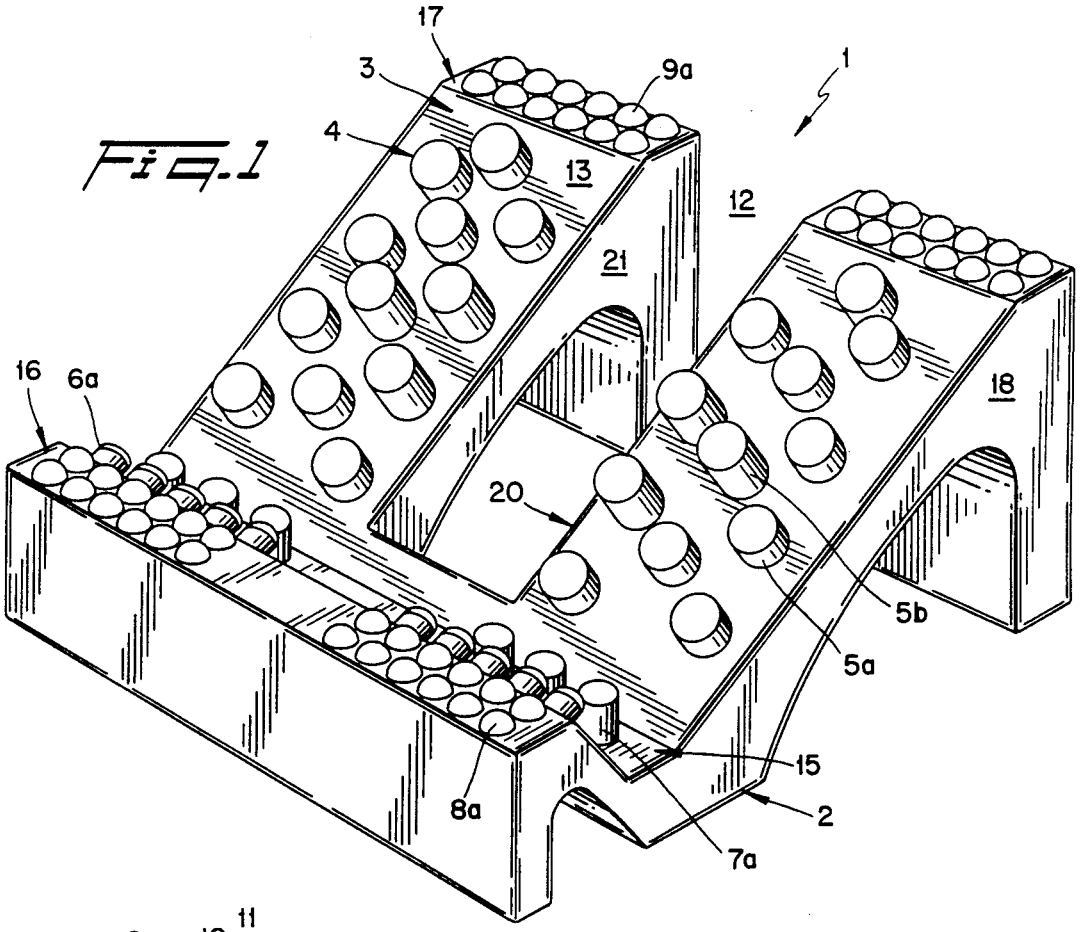
FIG. 1 is a perspective view of the device according to the invention.
Figure 2:
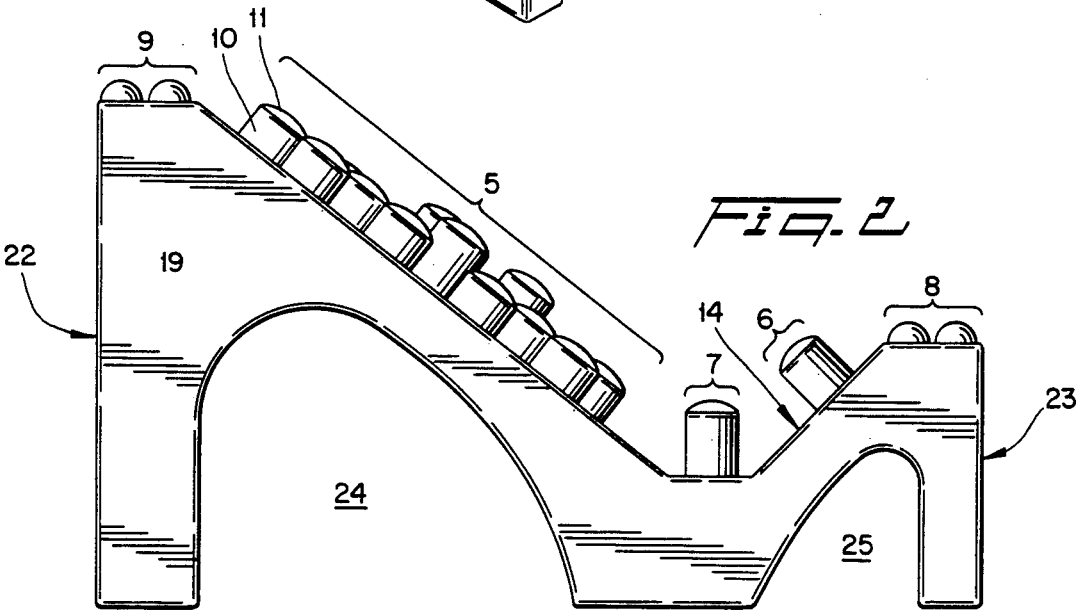
FIG. 2 is a side-view of the device shown in FIG. 1.

The present invention provides a foot massaging device 1 as shown in FIGS. 1 and 2. The device 1 is multi-purpose in that it includes projections which can be used in various ways. For instance, the device 1 can support and massage both feet of a person simultaneously while the person is comfortably seated. In particular, a person can be seated with the person's legs extending vertically and the person's feet angled downwardly such that the point pressure from the device due to the projections is applied to soles of the feet. According to the preferred embodiment of the invention, the device 1 comprises a rigid unitary structure which does not include moving parts or special features such as heating means, water spraying means, etc. Of course, the device 1 according to the invention could be incorporated in foot massaging devices which include means for applying a water spray to the soles of the feet, means for applying heat to the feet either by providing heating means within the device 1 or by providing the device 1 in a heated medium such as water or some other fluid medium.

The device 1 includes a lower surface 2 adapted to rest on a floor and an upper surface 3. The device 1 includes protrusions 4 on the upper surface 3. In accordance with the preferred embodiment of the invention, the protrusions 4 include a first group 5, a second group 6, a third group 7, a fourth group 8, and a fifth group 9.

The first group 5 has upper surfaces thereof arranged so as to support the sole of each foot such that the heel of the foot is vertically above the toes of the foot. The second group 6 has upper surfaces thereof arranged so as to support the toes of the foot such that they are bent upwardly at an angle to the sole of the foot. The upper surfaces of the first group 5 of protrusions are closer to a plane containing the lower support surface 2 at positions located closer to the second group 6 of protrusions and the upper surfaces of the second group 6 of protrusions are closer to the plane at positions located closer to the first group 5 of protrusions. The first group 5 extends over a first distance in a direction towards the second group 6 and the second group 6 extends over a second distance in a direction towards the first group, the first distance being greater than the second distance. As shown in FIG. 2, the first group of protrusions 5 are arranged such that the sole of a person's foot is angled downwardly with the heel located above the toes of the foot and the second group of protrusions 6 are arranged such that the toes of the foot are bent upwardly with the ball of the foot being located below the heel and toes of the foot. The device 1 can be used to support one or both feet of a person.

The third group of protrusions 7 have upper surfaces thereof vertically below the upper surfaces of the second group 6 and are arranged so as to support the ball of the foot. The device 1 could be constructed without the third group of protrusions 7. The third group 7 is desirable, however, for providing point pressure to the ball of the foot as pressure to this area is considered beneficial for the eyes. The fourth group of projections 8 and the fifth group of projections 9 are optional. However, when the fourth and/or fifth group of projections are incorporated in the device 1, they can be used to massage different portions of the foot when the foot is not supported by the first and second groups of projections.

The projections 4 can include sidewalls 10 which depend from upper surfaces 11 thereof. The sidewalls 10 can be parallel to each other or can be at various angles to each other as shown in FIG. 2. In accordance with one embodiment of the invention, the sidewalls 10 are parallel to the vertical direction such that the device 1 can comprise a single molded piece of plastic. For instances, the device 1 can comprise a single sheet of plastic which is heated and pressed into a configuration similar to that shown in FIG. 2, except that the first group of projections 5 and the second group of projections 6 will have their sidewalls 10 extending in a vertical direction parallel to the sidewalls of the third group of projections 7. This will allow easy removal of the device 1 from a suitably shaped mold.

The projections 4 can have various shapes such as the hemispherical shapes of the fourth and fifth groups of projections 8, 9. The projections 4 can be cylindrical in shape with rounded upper surfaces 11 as shown for the first, second, and third groups of projections 5–7.

The device 1 can include cut-out means 12 extending through a central part of one side thereof for receiving a leg of a chair to facilitate placement of the device 1 directly under the chair. For instance, the chair leg could be a horizontally extending leg of a swivel chair. The cut-out 12 thus serves as an anchoring means to prevent lateral displacement of the device 1 when it is being used. The cut-off 12 also makes the device lighter in weight.

The projections 4 are supported on different parts of the upper surface 3. For instance, the first group of projections 5 are supported on a first surface 13 of the device and the second group of protrusions 6 are supported on a second surface 14 of the device. The first and second surfaces are inclined such that they are closer together at a lower end thereof than at an upper end thereof. The third group of protrusions 7 are supported on a third surface 15 which extends between the first and second surfaces. The second surface 14 forms an angle with the third surface 15 as shown in FIG. 2. This angle can be greater, equal, or less than the angle formed between the first surface 13 and the third surface 15. As shown in FIG. 2, the angles between the third surface 15 and the first and second surfaces 13, 14 are about equal to each other. As shown, the angles are about 45°.

The first group of protrusions 5 can include short protrusions 5*a* and long protrusions 5*b*. The long protrusions 5*b* can be arranged to support the plantar arch of each foot and the short protrusions 5*a* can be arranged to support the remainder of the soles of each foot.

In accordance with the preferred embodiment of the invention, the second group of protrusions 6 are located between the fourth group of protrusion 8 and the third group of protrusions 7 and the first group of protrusions 5 are located between the fifth group of protrusions 9 and the third group of protrusions 7. The fourth group of protrusions 8 have upper surfaces which are spaced further from the lower support surface 2 than the upper surfaces of the third group of protrusions 7. Also, the fifth group of protrusions 9 have upper surfaces which are spaced further from the lower support surface 2 than the upper surfaces of the fourth group of protrusions 8.

The protrusions 5 can be arranged in any suitable pattern such as in rows or randomly arranged on the first surface 13. Preferably, the protrusions 5 are arranged in a pattern which entirely covers the sole of a person's foot. The third group of protrusions 7 are preferably arranged in a single row extending in a direction parallel to adjoining edges of the first surface 13 and the third surface 15. Similarly, the fourth group of protrusions 8 preferably comprise at least one row of protrusions extending in a direction parallel to adjoining edges of the fourth surface 16 and the second surface 14. As shown in FIGS. 1 and 2, the fourth group can comprise two parallel rows of protrusions. At least some of the protrusions 8 can be hemispherical in shape as shown by protrusion 8*a* in FIG. 1. The fifth group of protrusions 9 can comprise at least one row of protrusions extending in a direction parallel to adjoining edges of the fifth surface 17 and the first surface 13. In the preferred embodiment, the fifth group of protrusions 9 comprise two parallel rows of protrusions with at least some of the protrusions being hemispherical in shape as shown by protrusion 9*a* in FIG. 1.

The cut-out 12 extends through a side of a support such that it passes through the fifth surface 17 and part of the first surface 13. The device 1 includes a first sidewall 18 and an opposite second sidewall 19. The cut-out 12 is defined by a first inner sidewall 20 and a second inner sidewall 21 spaced from the first inner sidewall 20. As shown in FIG. 1, the sidewalls 18–21 can be parallel to each other. The device 1 also includes a first end wall 22 extending between the lower surface 2 and the fifth surface 17. The device 1 includes a second end wall 23 extending between the lower surface 2 and the fourth surface 16. The device 1 can include open areas to reduce the weight of the device. For instance, a large open area 24 can be provided beneath the first group of projections 5. In particular, the large open area 24 extends through the sidewalls 18–21. A small open area 25 can be provided beneath the second group of projections 6. In particular, the small open area 25 extends through the sidewalls 18–21. Additional open areas could be provided in the end wall 22 and/or the end wall 23.

While the invention has been described with reference to the foregoing embodiments, various changes and modifications may be made thereto which fall within the scope of the appended claims.

What is claimed is:

1. A foot massaging device which can support and massage one or both feet of a person simultaneously while the person is comfortably seated with the person's legs extending vertically and the person's feet angled downwardly such that point pressure from the device is applied to soles of the foot or feet, the device comprising:

a support having a lower surface adapted to rest on a floor and protrusions on an upper surface of the support;

first support means for supporting at least one sole of a person's foot such that the heel of the foot is vertically above the toes of the foot, said first support means comprising a first group of the protrusions having upper surfaces thereof arranged so as to support the sole of the foot such that the heel of the foot is vertically above the toes of the foot; and second support means for supporting the toes of the foot such that they are bent upwardly at an angle to the sole of the foot, the second support means comprising a second group of the protrusions having upper surfaces thereof arranged so as to support the toes of the foot such that they are bent upwardly at an angle to the sole of the foot, the upper surfaces of the first group of protrusions being closer to a plane containing the lower support surface at positions located closer to the second group of protrusions and the upper surfaces of the second group of protrusions being closer to the plane at positions located closer to the first group of protrusions.

2. The device of claim 1, further comprising third support means for supporting the ball of the foot, the third support means comprising a third group of the protrusions having upper surfaces thereof vertically below the upper surfaces of the second group and arranged so as to support the ball of the foot.

3. The device of claim 2, further comprising a fourth group of protrusions having upper surfaces thereof arranged to be out of contact with the foot when the foot is supported on the first and second groups of protrusions, the fourth group of protrusions being usable to massage a foot which is not supported on the first and second groups of protrusions.

4. The device of claim 1, wherein the first support means extends over a first distance in a direction towards the second support means and the second support means extends over a second distance in a direction towards the first support means, the first distance being greater than the second distance.

5. The device of claim 1, wherein the upper surfaces of the protrusions are rounded.

6. The device of claim 1, wherein the first group of protrusions are supported on a first surface of the support and the second group of protrusions are supported on a second surface of the support, the first and second surfaces being inclined such that they are closer together at a lower end thereof than at an upper end thereof.

7. The device of claim 6, further comprising a third group of protrusions having upper surfaces thereof arranged so as to support the ball of the foot.

8. The device of claim 7, wherein the third group of protrusions are supported on a third surface extending between the first and second surfaces.

9. The device of claim 8, wherein the second surface forms an angle with the third surface which is about equal to an angle formed between the first and third surfaces.

10. The device of claim 8, wherein the third group of protrusions comprises at least one row of protrusions extending in a direction parallel to adjoining edges of the first and third support surfaces.

11. The device of claim 6, further comprising a third group of protrusions supported on a third surface of the support located between the first and second surfaces, a fourth group of protrusions supported on a fourth surface of the support located such that the second surface is between the fourth surface and the third surface, and a fifth group of protrusions supported on a fifth support surface of the support located such that the first surface is between the fifth surface and the third surface.

12. The device of claim 11, wherein the fourth group of protrusions comprises at least one row of protrusions extending in a direction parallel to adjoining edges of the fourth and second surfaces.

13. The device of claim 12, wherein the fourth group comprises two parallel rows of protrusions, at least some of the protrusions being hemispherical in shape.

14. The device of claim 11, wherein the fifth group of protrusions comprises at least one row of protrusions extending in a direction parallel to adjoining edges of the fifth and first surfaces.

15. The device of claim 11, wherein the fifth group comprises two parallel rows of protrusions, at least some of the protrusions being hemispherical in shape.

16. The device of claim 1, wherein the first group of protrusions include long protrusions and short protrusions, the long protrusions being arranged to support the plantar arch of each foot and the short protrusions being arranged to support the remainder of the soles of each foot.

17. The device of claim 1, further comprising a third group of protrusions having upper surfaces thereof arranged so as to support the ball of the foot, a fourth group of protrusions and a fifth group of protrusions, the third group of protrusions being located between the first and second groups of protrusions, the second group of protrusions being located between the fourth and third groups of protrusions and the first group of protrusions being located between the fifth and third groups of protrusions, the fourth group of protrusions having upper surfaces which are spaced further from the lower support surface than the upper surfaces of the third group of protrusions and the fifth group of protrusions having upper surfaces which are spaced further from the lower support surface than the upper surfaces of the fourth group of protrusions.

18. The device of claim 1, wherein the support and the protrusions comprise a single molded piece of plastic.

19. A foot massaging device which can support and massage both feet of a person simultaneously while the person is comfortably seated with the person's legs extending vertically and the person's feet angled downwardly such that point pressure from the device is applied to soles of the feet, the device comprising:

a support having a lower surface adapted to rest on a floor and protrusions on an upper surface of the support;

first support means for supporting at least one sole of a person's foot such that the heel of the foot is vertically above the toes of the foot, said first support means comprising a first group of the protrusions having upper surfaces thereof arranged so as to support the sole of the foot such that the heel of the foot is vertically above the toes of the foot;

second support means for supporting the toes of the foot such that they are bent upwardly at an angle to the sole of the foot, the second support means comprising a second group of the protrusions having upper surfaces thereof arranged so as to support the toes of the foot such that they are bent upwardly at an angle to the sole of the foot; and a cut-out means extending through a central part of one side thereof for receiving a horizontally extending leg of a swivel chair to facilitate placement of the support directly under the chair.

20. A foot massaging device which can support and massage both feet of a person simultaneously while the person is comfortably seated with the person's legs extending vertically and the person's feet angled downwardly such that point pressure from the device is applied to soles of the feet, the device comprising:

a support having a lower surface adapted to rest on a floor and protrusions on an upper surface of the support;

first support means for supporting at least one sole of a person's foot such that the heel of the foot is vertically above the toes of the foot, said first support means comprising a first group of the protrusions having upper surfaces thereof arranged so as to support the sole of the foot such that the heel of the foot is vertically above the toes of the foot;

second support means for supporting the toes of the foot such that they are bent upwardly at an angle to the sole of the foot, the second support means comprising a second group of the protrusions having upper surfaces thereof arranged so as to support the toes of the foot such that they are bent upwardly at an angle to the sole of the foot, the first group of protrusions being supported on a first surface of the support and the second group of protrusions being supported on a second surface of the support, the first and second surfaces being inclined such that they are closer together at a lower end thereof than at an upper end thereof;

a third group of protrusions supported on a third surface of the support located between the first and second surfaces, a fourth group of protrusions supported on a fourth surface of the support located such that the second surface is between the fourth surface and the third surface, and a fifth group of protrusions supported on a fifth support surface of the support located such that the first surface is between the fifth surface and the third surface; and a cut-out extending through a side of the support, the cut-out passing through the fifth surface, and part of the first surface.

* * * * *